US009302401B2

(12) United States Patent
Geiser et al.

(10) Patent No.: US 9,302,401 B2
(45) Date of Patent: Apr. 5, 2016

(54) TRIMMER COMB, HAIR TRIMMER COMPRISING A TRIMMER COMB AND METHOD OF MANUFACTURING A TRIMMER COMB

(71) Applicant: Braun GmbH, Kronberg (DE)

(72) Inventors: Klaus-Dieter Geiser, Neu-Anspach (DE); Juergen Behrendt, Brechen (DE); Andreas Larscheid, Sulzbach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 14/319,186

(22) Filed: Jun. 30, 2014

(65) Prior Publication Data

US 2014/0310963 A1 Oct. 23, 2014

Related U.S. Application Data

(63) Continuation of application No. 12/811,289, filed on Jan. 27, 2009, now abandoned.

(51) Int. Cl.
*B26B 19/38* (2006.01)

(52) U.S. Cl.
CPC ..... *B26B 19/3846* (2013.01)

(58) Field of Classification Search
CPC ..... B26B 19/3846
USPC ..... 30/30, 53, 54, 55, 223, 224, 225, 233.5; 132/219
See application file for complete search history.

(56) References Cited

U.S. PATENT DOCUMENTS

| | | | | | |
|---|---|---|---|---|---|
| 1,780,276 | A | * | 11/1930 | Scheiwer | 30/223 |
| 2,587,235 | A | * | 2/1952 | Seferlis | 30/30 |
| 2,726,441 | A | * | 12/1955 | Brody | 30/30 |
| 3,029,509 | A | * | 4/1962 | Peters | 30/30 |
| 3,835,870 | A | * | 9/1974 | Sick | 132/160 |
| 3,959,878 | A | * | 6/1976 | Irelan et al. | 30/220 |
| 4,216,582 | A | * | 8/1980 | Paule et al. | 30/216 |
| 4,348,810 | A | * | 9/1982 | Oda et al. | 30/210 |

(Continued)

FOREIGN PATENT DOCUMENTS

| | | | |
|---|---|---|---|
| EP | 2 085 194 A1 | * | 8/2009 |
| JP | 52-46969 | * | 4/1977 |

(Continued)

*Primary Examiner* — Hwei C Payer
(74) *Attorney, Agent, or Firm* — Ronald Terk Sia; Kevin C. Johnson; Steven W. Miller

(57) ABSTRACT

The invention is concerned with a trimmer comb (1) that comprises a base sheet (10) that has a toothed front side, the toothed front side comprising a side-by-side arrangement of guard teeth (11) and narrow teeth (12), wherein the tips (15, 11*d*, 11*d'*) of the guard teeth (11) are wider in the longitudinal extension direction (y) of the trimmer comb than the tips (15') of the narrow teeth (12) and the geometry of the narrow teeth (12) is reduced when compared to the geometry of the guard teeth (11). These two different trimmer comb teeth geometries serve to press down skin and to avoid injuries by hooking of trimmer comb teeth into skin pores or channels, while a high cutting efficiency is ensured because of the reduced geometry of the narrow teeth ultimately allowing a reduced average spacing distance between the trimmer teeth for a given width of the guard teeth tips. The invention is also concerned with a hair trimmer comprising such a trimmer comb and a hair removal device comprising such a hair trimmer.

11 Claims, 6 Drawing Sheets

(56) References Cited

U.S. PATENT DOCUMENTS

Figure 1:
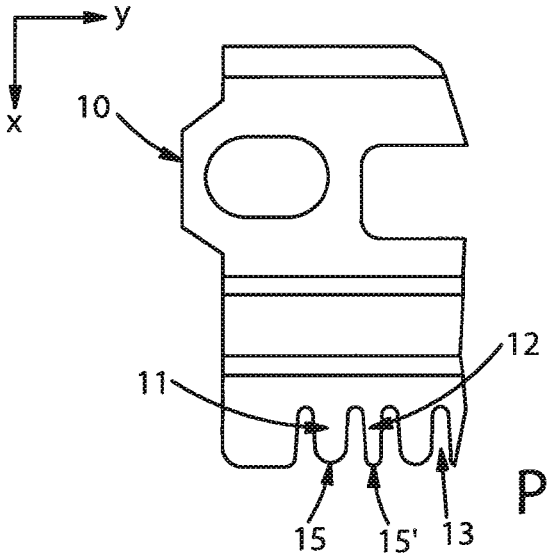
Fig. 1 PRIOR ART

| | | | | | |
|---|---|---|---|---|---|
| 5,318,051 | A | * | 6/1994 | Koppel | 132/126 |
| 5,461,780 | A | * | 10/1995 | Morana | 30/30 |
| 5,581,891 | A | * | 12/1996 | Wheeler et al. | 30/216 |
| 5,600,890 | A | * | 2/1997 | Leitner et al. | 30/223 |
| 7,841,091 | B2 | * | 11/2010 | Melton | 30/223 |
| 2009/0126201 | A1 | * | 5/2009 | Melton | 30/208 |
| 2009/0320296 | A1 | * | 12/2009 | Morisugi et al. | 30/43.92 |
| 2010/0299937 | A1 | * | 12/2010 | Geiser et al. | 30/233.5 |
| 2011/0016729 | A1 | | 1/2011 | Geiser et al. | |
| 2014/0310963 | A1 | * | 10/2014 | Geiser et al. | 30/233.5 |

FOREIGN PATENT DOCUMENTS

| | | | |
|---|---|---|---|
| JP | 54-130272 | * | 10/1979 |
| JP | 2-52688 | * | 2/1990 |
| JP | 3-140181 | * | 6/1991 |
| JP | 2000-308768 | * | 11/2000 |
| JP | 2003-53063 | * | 2/2003 |
| JP | 2010-4991 | * | 1/2010 |
| JP | 2010-4993 | * | 1/2010 |
| JP | 2010-4994 | * | 1/2010 |
| JP | 2010-4995 | * | 1/2010 |
| JP | 2010-119790 | * | 6/2010 |
| WO | WO 2007/069177 | * | 6/2007 |

* cited by examiner

TRIMMER COMB, HAIR TRIMMER COMPRISING A TRIMMER COMB AND METHOD OF MANUFACTURING A TRIMMER COMB

The invention is concerned with a trimmer comb, a hair trimmer device comprising a trimmer comb, a hair removal device comprising a hair trimmer device, and a method of manufacturing a trimmer comb.

Japanese patent application JP 02-052688 discloses a trimmer comb having a toothed front side, where each trimmer comb tooth has a circular tip area in the trimmer comb plane. The diameter of the circular tip area is larger than the width of the tooth at the position where the circular tip is attached to the tooth. When viewed from the side, the trimmer teeth have an approximately hemispherical thickening that forms the tip of the trimmer teeth. The thickened tips induce a pleasant skin contact sensation.

International patent application WO 2007/069177 A2 also discloses thickened tips of trimmer comb teeth, specifically focusing on the problem of hooking of trimmer comb teeth into skin pores or hair channels, causing painful injuries.

It is evident that hooking of trimmer teeth into skin pores can be avoided by thickened trimmer tooth tips and that cutting of skin that penetrates through tooth gaps can be avoided by narrow tooth gaps. But it is a disadvantage of the known designs that wide trimmer tooth tips avoiding injuries by hooking require a certain tooth spacing that is given by the required tip width. This relatively large tooth spacing leads to a reduced cutting efficiency of the known trimmer combs.

It is hence an object of the present invention to provide a trimmer comb that avoids injuries while a high cutting efficiency is ensured.

The proposed trimmer comb comprises a base sheet that has a toothed front side (as is generally known in the art). The toothed front side comprises a side-by-side arrangement of guard teeth and narrow teeth. The guard teeth have tips that are wider in the longitudinal extension direction of the trimmer comb (which is the lateral extension direction of the guard teeth, respectively) than the tips of the narrow teeth. Additionally, the geometry of the narrow teeth is reduced when compared to the geometry of the guard teeth. Hence, at least an additional geometry parameter of the narrow teeth (besides their reduced tip width) is reduced when compared to the geometry of the guard teeth. E.g., in case a guard teeth has a given width from its tip to its base at the base sheet, the narrow tooth could not only have a smaller tip width but could have this reduced width from its tip to its base at the base sheet. This allows having e.g. an alternating arrangement of guard teeth having a certain width over their extension length and of narrow teeth having a smaller width over their extension length. Of course, any other periodic or non-periodic arrangement of guard teeth and narrow teeth is possible. In this way, the average spacing distance between the trimmer comb teeth could be reduced, as wide teeth (the guard teeth) and less wide teeth (the narrow teeth) are alternately arranged having the same tooth gap between them. The reduced (average) spacing distance leads to a higher cutting efficiency as a higher number of tooth gaps for cutting hairs are provided when compared with a trimmer comb where only guard teeth are arranged. The presence of the wide guard teeth provides a reduction of hooking injuries when compared with a trimmer comb where only narrow teeth are arranged.

In an embodiment of the proposed trimmer comb, the reduced geometry of the narrow teeth is obtained in that the length of the narrow tooth measured in axial direction of the trimmer comb teeth is smaller than the length of the guard teeth and/or the base spacing of the narrow tooth is smaller than the base spacing of the guard teeth. By reducing the length of the narrow teeth, space is freed for moving the wide tips of the guard teeth closer together (as the narrow teeth are retracted) so that the average spacing distance between narrow teeth and guard teeth can be reduced for a given tip width of the guard teeth as in the case where the narrow teeth extend as far as the guard teeth. In case the base spacing of the narrow teeth is reduced (which essentially means that the overall width of the narrow teeth is reduced when compared to the guard teeth in case that the width of the tooth gaps is kept unchanged), this also allows for a reduced average spacing distance between guard teeth and narrow teeth.

In an embodiment of the proposed trimmer comb, a narrow tooth is arranged between two guard teeth. In this alternating arrangement, the benefits of the different geometries of the guard teeth and the narrow teeth could be used by adapting the reduced geometry of the narrow teeth to the geometry of the guard teeth and the required width of the tooth gaps.

In another embodiment of the proposed trimmer comb, the thickness of the base sheet is equal to or smaller than 0.4 mm, in particular the thickness of the base sheet is equal to or smaller than 0.3 mm. As the proposed reduced geometry of the narrow teeth allows reducing the average spacing distance, the tooth gaps could become smaller and as a result, the skin can not easily penetrate through the tooth gaps and gets cut, which allows using a thin base sheet as thin as about 0.3 mm.

In an embodiment of the proposed trimmer comb, the centre-to-centre spacing distance between a narrow tooth and an adjoining tooth gap is smaller than the centre width of a guard tooth, in particular, the centre-to-centre spacing distance of a narrow tooth and an adjoining tooth gap is about the centre width of a narrow tooth.

In a further embodiment of the proposed trimmer comb, the tips of the guard teeth define a skin contact edge (or: the tips of the guard teeth define an enveloping edge of the trimmer comb front) and the narrow teeth do not extend until the skin contact edge as a specific realization of the reduced geometry of the narrow teeth. This specific design further ensures that hooking of the smaller tips of the narrow teeth is effectively avoided (even though the wide tips of the guard teeth press down the skin, the skin may raise—specifically in regions where the skin is flexible—and the tips of the narrow teeth may still hook into skin pores or hair channels). Additionally, as the narrow teeth do not extend up to the skin contact edge, the tips of the guard teeth can be designed even wider, as the tips of the narrow teeth are in a retracted position. This enhances the ability of the trimmer comb to press down skin and the possibility for injuries is even better suppressed while a low average spacing distance between the trimmer comb teeth is preserved.

In a refinement of the previous embodiment, the tips of the guard teeth are about as wide or even wider (in the longitudinal extension direction of the trimmer comb) than the average spacing distance between the guard teeth and the narrow teeth.

In an embodiment of the proposed trimmer comb, the narrow teeth have a centre width that is 20% smaller than the centre width of the guard teeth, in particular this value is 30% and specifically this value is 40%.

In a further embodiment of the proposed trimmer comb, at least a guard tooth has a tip that is thickened in a height direction (the height direction being perpendicular to the trimmer comb plane spanned by the toothed front side of the trimmer comb). By having a wide tip of the guard tooth that is also thickened in the height direction, hooking is even better suppressed and a thickened tip (specifically, if it is a spherical tip portion) also may generate a skin contact sensation more pleasant than the skin contact sensation of a non-thickened tooth.

In a further refinement of the previous embodiment, the thickened tip comprises a thickened tip portion, where the thickened tip portion is extending only to one side of the guard tooth, in particular where this side is the skin side of the trimmer comb that is intended to contact the skin in a use state of the mounted trimmer comb. In a refinement of this embodiment, the thickened tip portion is a spherical structure that has a diameter larger than the thickness of the base sheet, in particular where the diameter of the spherical structure is at least twice as large as the thickness of the base sheet.

The invention also is concerned with a hair trimmer device in which a proposed trimmer comb is utilized and the invention further is concerned with a hair removal device in which such a hair trimmer device is a (integral) part.

Figure 4:
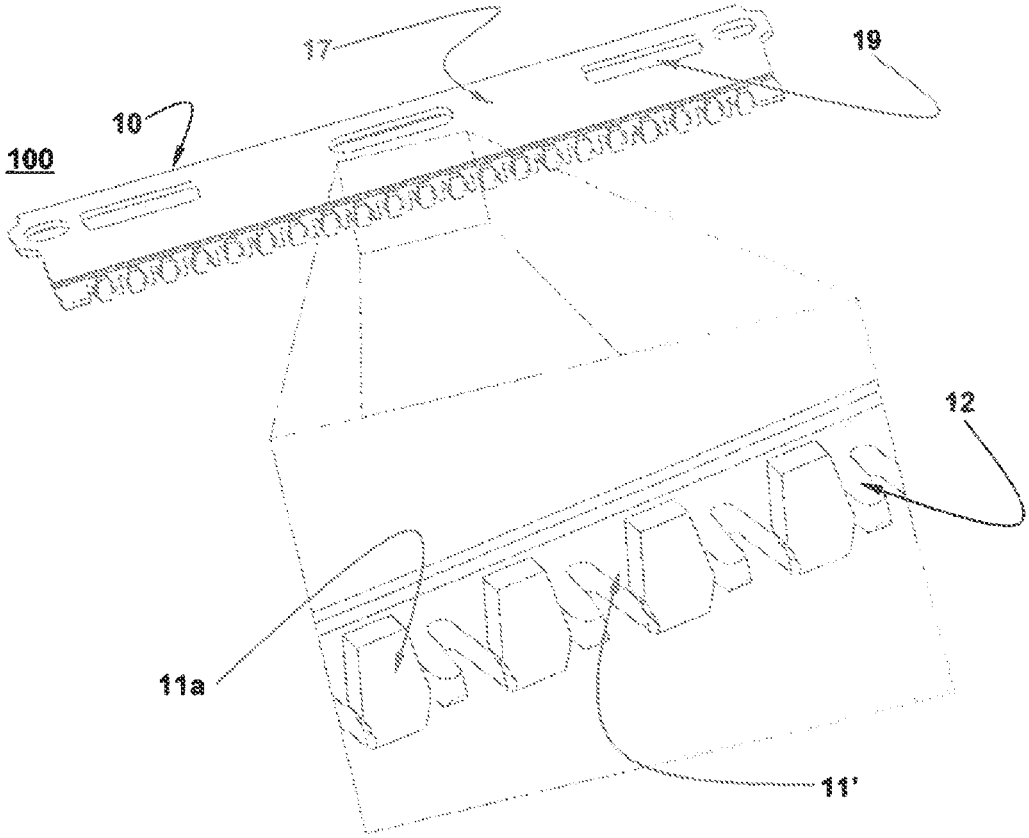
Figure 5:
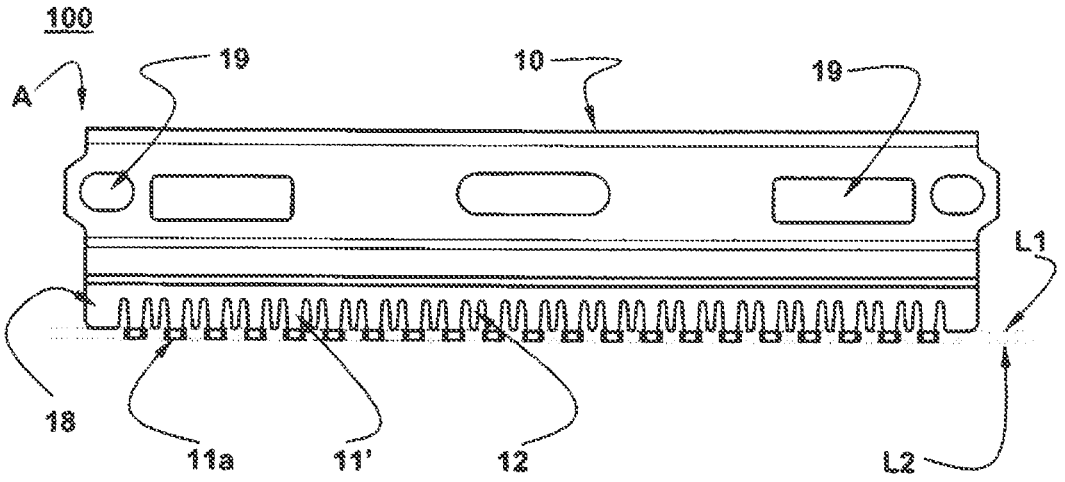
Figure 6:
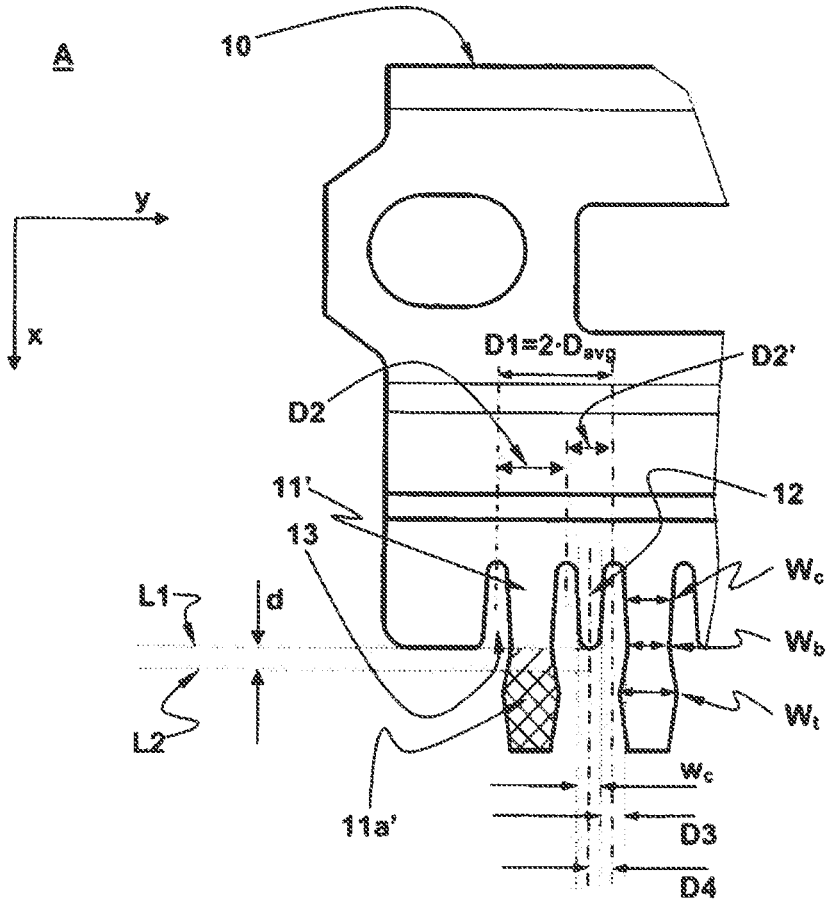
Figure 7:
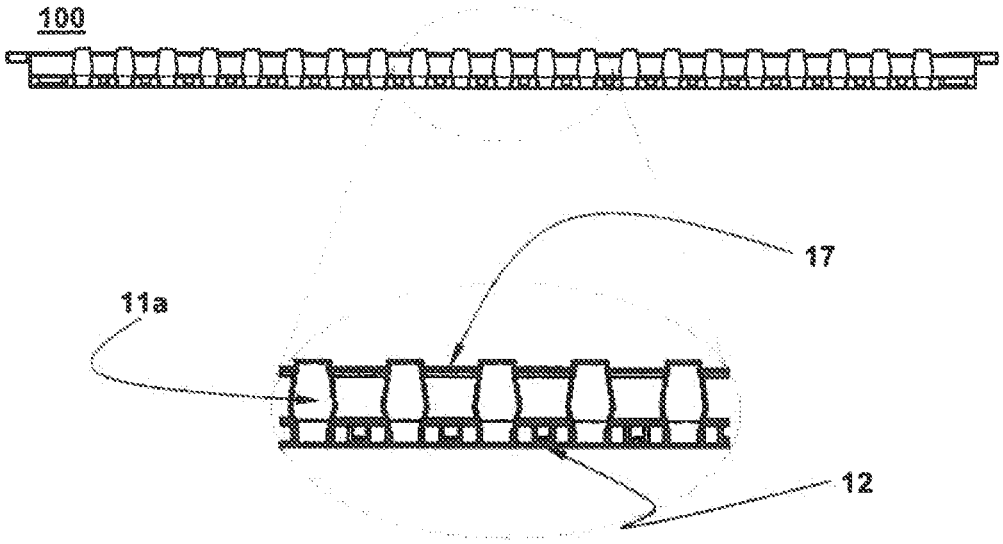
Figure 8:
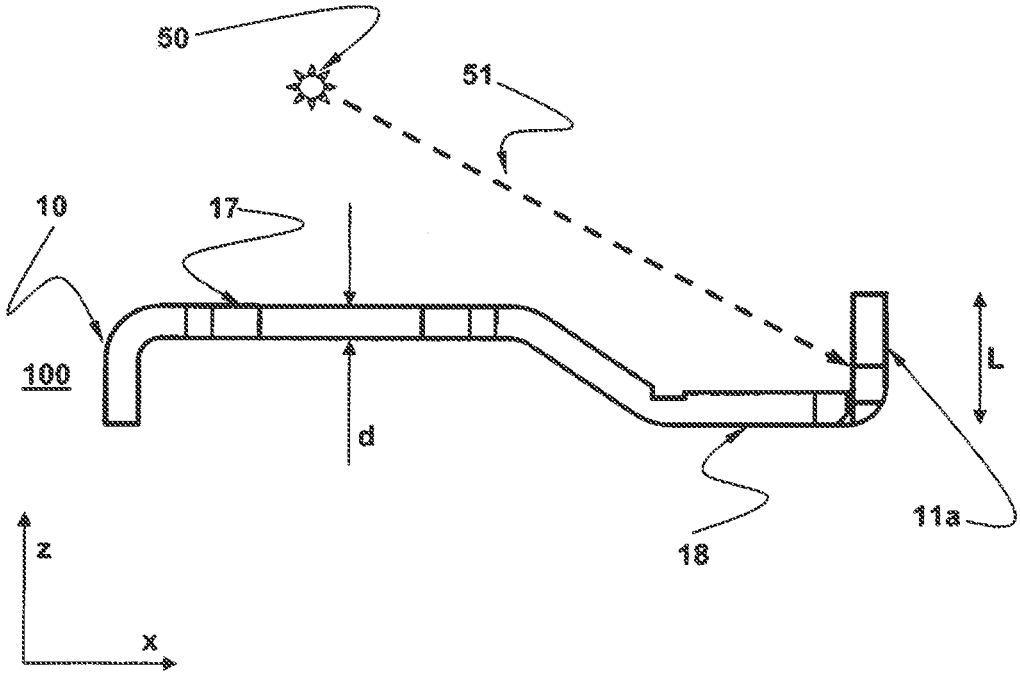
Figure 9:
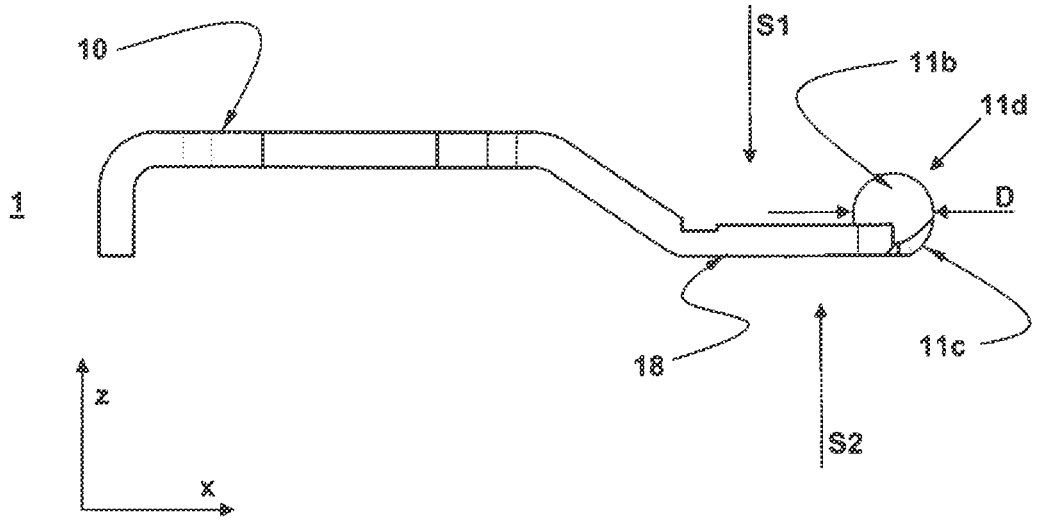
Figure 10:
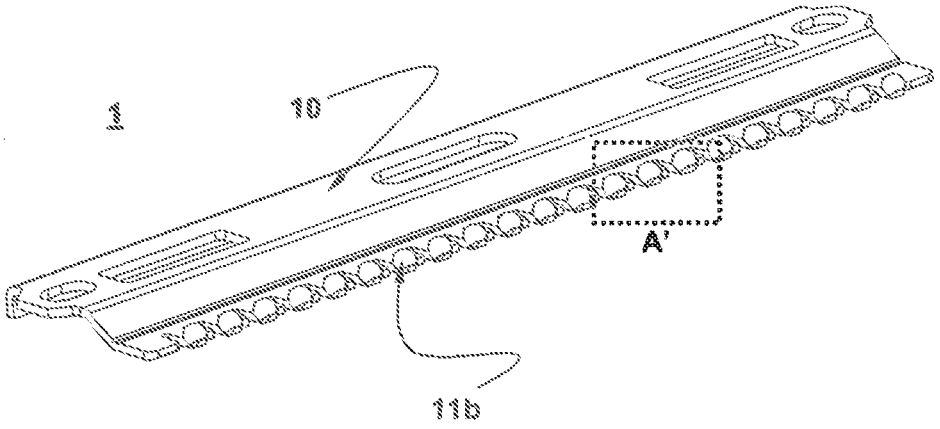
Figure 11:
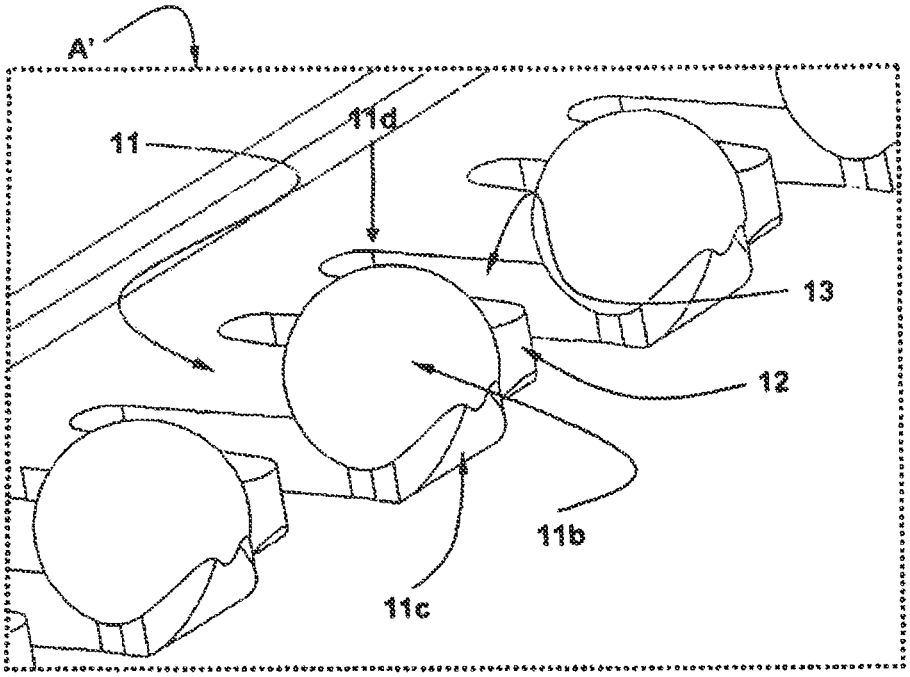
Figure 12:
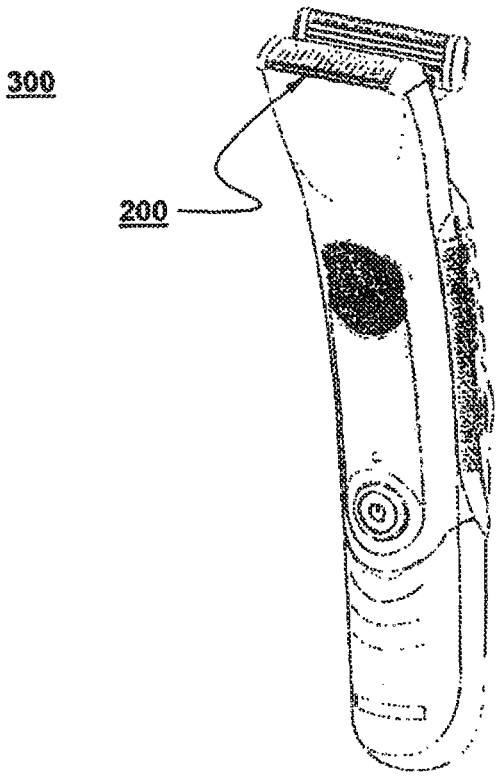

The invention will be further described in detail by explanation of exemplary embodiments and by reference to figures. In the figures FIG. 1 shows an exemplary detail of an exemplary trimmer comb having guard teeth for skin protection and narrow teeth for high cutting efficiency, FIG. 2 shows a schematic drawing of an exemplary embodiment of a toothed front side of a trimmer comb in a top view onto the comb plane, FIG. 3 shows a schematic drawing of a frontal view onto a toothed front side of a trimmer comb and a trimmer blade, where at the front of the trimmer comb various realization possibilities of guard teeth are indicated, FIG. 4 shows a perspective view onto an exemplary intermediate trimmer comb during manufacturing, where a detail of the toothed front side is magnified, FIG. 5 shows a top view onto the exemplary intermediate trimmer comb as shown in FIG. 4, FIG. 6 shows a top view onto a detail of an intermediate trimmer comb, FIG. 7 shows a frontal view onto the toothed front side of the intermediate trimmer comb as shown in FIG. 4, FIG. 8 shows a side view onto the intermediate trimmer comb as shown in FIG. 4 and indicates the application of energy onto a bent-over portion of a guard tooth, FIG. 9 shows a side view onto a trimmer comb in its final stage after energy had been applied to the bent-over portion so that a molten tip portion resulted, FIG. 10 shows a perspective view onto a trimmer comb in its final stage, FIG. 11 shows a magnification of a detail of the toothed front side of the trimmer comb as shown in FIG. 10, and FIG. 12 shows an exemplary hair removal device in which a trimmer comb is used as a part of a hair trimmer of the hair removal device.

A hair trimmer device for trimming hair usually comprises a trimmer comb and a trimmer blade, both having toothed front sides that have teeth that are arranged in a side-by-side manner and that extend in a comb plane and a blade plane, respectively. In a mounted state, the trimmer comb and the trimmer blade are arranged on top of each other so that the toothed front sides are superposed in a tight-fit manner, usually under pre-stress, e.g. applied by a spring. In an operation state, the toothed front sides of the trimmer comb and the trimmer blade are moved relatively to each other so that hairs that feed into the teeth gaps will be sheared off or cut off. Such a hair trimmer device, e.g. a beard trimmer, a long hair trimmer, a precision trimmer for facial hairs etc., could be a stand-alone device or the hair trimmer device could be a (integral) part of a different device, e.g. a hair removal device comprising a hair removal unit, such as an electric shaver or a wet shaver or an epilator head, and a hair trimmer device.

In the following, the description focuses on various embodiments of trimmer combs, but it is to be understood that the subject matter of the description shall encompass also hair trimmer devices and hair removal devices in which such a trimmer comb is employed.

Figure 2:
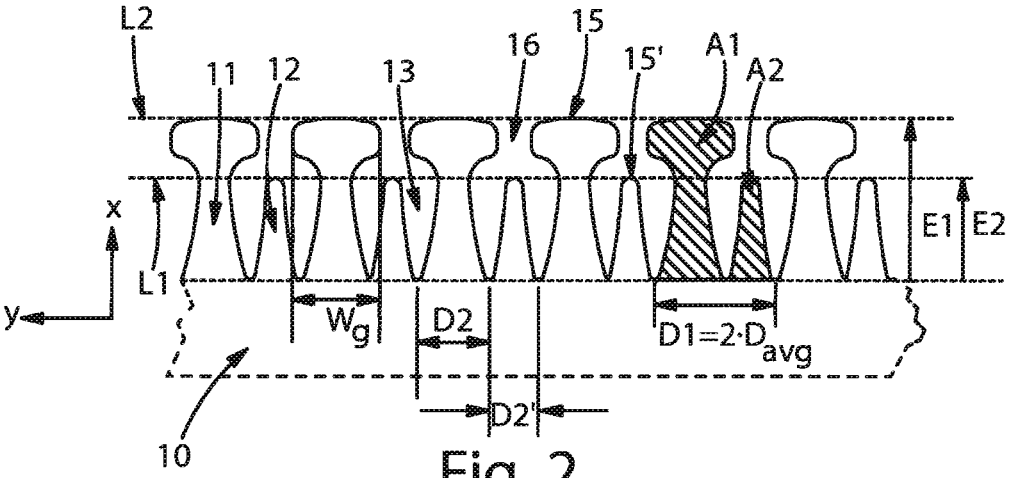
Figure 3:
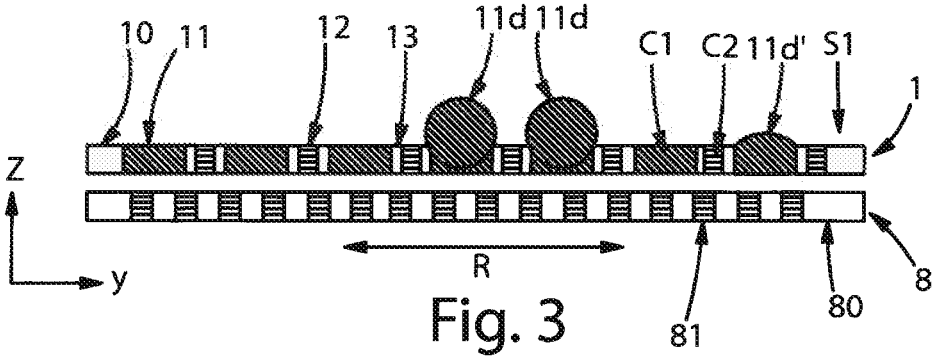
Fig. 3 PRIOR ART

FIG. 1 shows a detail of a trimmer comb (the shown detail corresponds to the detail A as indicated in FIG. 3 for another embodiment of a trimmer comb) that extends in a trimmer plane, where a Cartesian coordinate system spanning the trimmer comb plane is indicated, which coordinate system has an axis x that extends in a tooth extension direction and an axis y that extends in a longitudinal extension direction of the trimmer comb. The trimmer comb comprises a base sheet 10. The base sheet 10 has a toothed front side that has, in contrast to what is known from prior art trimmer combs, a first plurality of teeth 11 ("guard teeth") and a second plurality of teeth 12 ("narrow teeth") that have two different tooth geometries, in particular the guard teeth 11 have a wider width than the narrow teeth 12 (the tooth width is defined in the longitudinal extension direction of the trimmer comb, viz. the y direction as indicated by the Cartesian coordinates) and usually shall mean the centre width of the tooth—it is referred to $W_c$ and $w_c$ in FIG. 4), where the guard teeth 11 and the narrow teeth 12 are arranged side-by-side in an alternating manner. Each guard tooth 11 has a tip 15 that is wider than a tip 15' of a narrow tooth 12. Even though it is shown in FIG. 1, which shows an exemplary embodiment of a trimmer comb as proposed, that a single narrow tooth 12 is arranged between two guard teeth 11, any other periodic or non-periodic arrangement of guard teeth 11 and narrow teeth 12 should be covered by the subject matter of the description. The guard teeth 11 with their wide tips 15 serve to press down the skin, so that cutting the skin, especially in body areas where flexible and thin skin is present (e.g. in the armpit and the intimate area), is efficiently suppressed. In a further embodiment, the tips 15 of the guard teeth 11 are chosen so wide that they would not hook into a hair follicle opening at the skin surface (e.g. the width of the tips 15 could be 0.6 mm-1.0 mm). As the hair follicles openings at the skin surface (also named hair channels), specifically in the intimate area, are rather large in diameter (and further because of the funnel-like structure of the hair channels at the skin surface and because of the high flexibility of the skin in the intimate area), one would choose a rather large width of the tips 15 of the guard teeth 11. Without prejudice, the tips 15 of the guard teeth 11 (and also the tips 15' of the narrow teeth 12) could be rounded for a gentle skin feeling or the tips 15 of the guard teeth 11 could be thickened as is known in the art, e.g. the teeth of the trimmer comb utilized in the Braun Lady Shaver have laser-molten and thickened tips since 1985 to improve the skin contact sensation of the trimmer comb (FIG. 3 shows a schematic depiction of such a thickened tip **11*d'*). In a different embodiment, the guard teeth 11 extend beyond the narrow teeth 12 in the x direction so that the possibility of hooking of the narrow teeth 12 into hair channels is even further reduced (it is also referred to FIG. 2 and FIG. 11 for this feature). It is noted that the tooth gaps 13 between the guard teeth 11 and the narrow teeth 12 are chosen rather narrow (in an exemplary embodiment, the centre width of the tooth gaps 13 has about the same size as the centre width of the narrow teeth 12—e.g. the centre width of the narrow teeth 12 could be about 0.3 mm or even smaller). In combination with the wide guard teeth 11 and the narrow teeth 12, the narrow tooth gaps 13 ensure that even the flexible skin in the intimate area cannot penetrate through the tooth gaps 13** and cutting of the skin is avoided, while a high efficiency of the hair cutting performance of a hair trimmer device employing such a trimmer comb is ensured. It is shown that the narrow teeth have not only a less wide tip than the guard teeth but they have in general a reduced geometry. In the shown embodiment, the reduced geometry is obtained by narrow teeth that are less wide than the guard teeth over their complete extension length. Additionally or alternatively, as mentioned above, the reduced geometry could be obtained by a reduced extension length of the narrow teeth.

In FIG. 2 a schematic cut-out detail of another exemplary embodiment of a toothed front side of a trimmer comb as proposed is shown. The toothed front side of the base sheet 10 has again guard teeth 11 and narrow teeth 12 that are arranged in an alternating side-by-side manner. The guard teeth 11 have a mushroom-like geometry, where the tips 15 of the guard teeth 12 are widened similarly to the head of a mushroom. The narrow teeth 12 have a reduced geometry when compared to the guard teeth 11. They slightly taper from the base of the narrow teeth 12 at the base sheet 10 to the tips 15' of the narrow teeth 12 and are generally less wide than the guard teeth 11. The guard teeth 11 extend in x direction until a line L2 that represents a skin contact edge. The narrow teeth 12 extend in x direction only until a line L1. The mushroom-like tips 15 of the guard teeth 11 are formed between line L1 and line L2. As the narrow teeth 12 extend only until line L1, the tips 15 of the guard teeth 11 can be made rather wide, as the spacing area between the tips 15 is not needed by the tips 15' of the narrow teeth 12. In this way, wide tips 15 can be formed; those wide tips 15 serve to press down the skin and also, in case the width of the tips 15 is chosen wide enough, they do not hook into skin pores or hair channels. Still, a gap 16 sufficiently wide to feed hairs into the teeth gaps 13, where the hairs will ultimately be cut in a use operation, remains. As the stems of the mushroom-like formed guard teeth 11 can be made less wide as the tips 15 of the guard teeth 11, a low average spacing distance $D_{avg}$ (measured in y direction) between guard teeth 11 and narrow teeth 12 can be achieved, so that a high cutting efficiency of the proposed trimmer comb is obtained. The individual base spacing of a guard tooth, measured from the base centre of a tooth gap 13 on one side of a guard tooth 11 to the base centre of a tooth gap 13 on the other side of the same guard tooth 11, is D2 and the base spacing of a narrow tooth measured between a base centre of a tooth gap 13 on one side of a narrow tooth 12 to the base centre of a tooth gap 13 on the other side of the same narrow tooth 12, is D2', so that $D1=D2+D2'=2\cdot D_{avg}$. It is a specific feature of the discussed embodiments that D2>D2', as the smaller base spacing D2' of the narrow teeth 12 leads to the good cutting efficiency, while the larger base spacing D2 allows to have wide tips of the guard teeth 11. If, as shown, the narrow teeth 12 are additionally retracted (do not extend up to the skin contact edge L2), the tips 15 could be made even wider than would be allowed for equally long guard teeth 11 and narrow teeth 12, as the retracted narrow teeth 12 leave enough space for hairs to become fed into the tooth gaps 13 even with those very wide tips 15 as shown. Hence, in the discussed embodiment, the width $W_g$ of the tips 15 of the guard teeth 11 (the width $W_g$ is defined as the maximum extension in y direction of the widened tip 15) is larger than the average spacing distance $D_{avg}$ between the trimmer comb teeth. Here, having an alternating arrangement of guard teeth 11 and narrow teeth 12, the average spacing distance $D_{avg}$ is half the spacing distance D1 between pairs of a guard tooth 11 and a narrow tooth 12. In a non-periodic arrangement of guard teeth 11 and narrow teeth 12, the overall width of the toothed front side of the trimmer comb in y direction divided by the number of teeth defines the average spacing distance $D_{avg}$. Generally, the guard teeth 11 cover an area A1 (measured from their basis at the base sheet 10) in the trimmer comb plane that is larger than the area A2 of the narrow teeth 12. For the shown specific embodiment, the width $W_g$ of the tips 15 of the guard teeth 11 could be about 0.7 mm while an average spacing distance between tooth gaps 13 of about 0.45 mm is achieved. The width of the tip 15' of a narrow tooth 12 would be measured at a line where the tapered part of the narrow tooth 12 merges with the rounded tip portion. If the tip 15' of a narrow tooth 12 would be flat at the front, the width of the flat front would be taken as the width of the tip 15' of the narrow tooth 12.

In FIG. 2 it is also shown that the length E2 of the narrow teeth 12 (the extension of the narrow teeth 12 from the basis at the base sheet 10 to the tip measured in x direction) is smaller than the length E1 of the guard teeth 11. In this embodiment, the advantages of a reduced geometry obtained by narrow teeth 12 having a smaller width than the guard teeth 11 and by narrow teeth 12 being retracted are combined. As the definition of the width of a trimmer comb tooth is rather ambiguous for specific tooth geometries, it is clearer to state that the base spacing D2' of the narrow teeth 12 (the base spacing D2' being the centre-to-centre distance between the tooth gap 13 on one side of a narrow tooth 12 to the tooth gap 13 on the other side of the narrow tooth 12) is smaller than the base spacing D2 of the guard tooth 11. It is the gist of the present invention to allow for good skin protection while allowing for a high cutting efficiency by having a reduced geometry of the narrow teeth (the tip area being discarded from the definition of the reduced geometry, as the tips of the guard teeth 11 are anyhow wider than the tips of the narrow teeth 12). This can exemplary be achieved by a combination of those two factors, the reduction of the spacing distance of the narrow teeth 12 and the retraction of the narrow teeth 12. Various realizations of this general concept of the reduced geometry can therefore be realized by only having a reduced base spacing of the narrow teeth 11 or only having a retraction of the narrow teeth 12 or by a combination of both or by any other suitable reduction of geometry of the narrow teeth 12.

In FIG. 3 a schematic frontal view onto the toothed front side of an exemplary embodiment of a trimmer comb 1 (combining different features of trimmer combs as proposed) and of an associated trimmer blade 8 is shown. A Cartesian coordinate system with axis y (longitudinal extension direction) and axis z (height extension direction) is indicated. The trimmer blade 8 comprises a base sheet 80 and a toothed front side having trimmer blade teeth 81. Even though the trimmer blade 8 is depicted with some distance to the trimmer comb 1, the mounted trimmer blade 8 is contacting the trimmer comb 1 at least at the toothed front side in a tight-fit manner, usually under pre-stress, e.g. applied by a spring (not shown). In a use operation, the trimmer blade 8 and the trimmer comb 1 are moved relatively to each other in an oscillatory manner, as indicated by double arrow R. The trimmer comb 1 comprises a base sheet 10 having guard teeth 11 and narrow teeth 12. In between the guard teeth 11 and the narrow teeth 12 teeth gaps 13 are formed into which hairs feed in. In this schematic frontal view, the guard teeth 11 have a cross sectional area C1 defined by the tips 15 of the guard teeth that is larger than the cross sectional area C2 defined by the tips 15' of the narrow teeth 12. In another exemplary embodiment, the cross sections C1 could overlap with the cross sections C2, e.g. if the guard teeth 11 have mushroom-head shaped tips 15 as depicted in FIG. 2 that partially cover the tips 15' of the narrow teeth 12 when frontally viewed.

In the centre of the trimmer comb 1 as depicted in FIG. 3, two guard teeth 11 are shown that have a thickened tip 11*d*, which thickened tip 11*d* comprises a spherical tip portion that is formed on the skin side S1 of the trimmer comb. Instead of only designing guard teeth 11 with wide tips in y direction, the tips of the guard teeth 11 could also be thickened in z direction. The manufacturing and further details of such very large thickened tips 11*d* will be discussed further below. On the right hand side of FIG. 3 another embodiment of a thickened tip 11*d*' of a guard tooth 11 is schematically depicted. The tip 11*d*' is only slightly thickened in z direction when compared to the tips 11*d*. Such thickened tips 11*d*' are known, e.g. from the Braun Lady Shaver trimmer combs.

In the following, a specific embodiment of a trimmer comb for reduced risk for skin injuries and/or irritations and pleasing skin contact sensation is discussed. This specific embodiment is characterized by thickened tips (thickened in z direction, as indicated in FIG. 3) of guard teeth. A specific process is described to enable the manufacturing of extremely large thickened tips in comparison to the base sheet thickness. As is described in JP 02-052688, it is known to have hemispherical trimmer comb tips for a gentle skin feeling, but this document describes a manufacturing process of a trimmer comb involving sintering of ceramic powder, which is a very costly process. Further, in international patent application WO 2007/06177 A2 it is also described to use thickened tooth tips to reduce the possibility of hooking of the trimmer comb teeth into skin pores or hair channels, but this document does not describe any manufacturing possibilities of thickened tips. While the following embodiment is described with respect to a plurality of guard teeth having thickened tips and a plurality of narrow teeth that are arranged in an alternate manner, it is to be understood that the described solution to the object of providing a trimmer comb with improved skin contact sensation can also be employed for trimmer combs having only guard teeth.

FIG. 4 shows a perspective view onto an intermediate trimmer comb 100 in an intermediate manufacturing step after a base sheet 10 was punched and folded into the shown form. A detail of the intermediate trimmer comb 100 is magnified for improved visibility of details of the toothed front side. The base sheet 10 has an elevated middle section 17 that has perforations 19 for placing the final trimmer comb onto a carrier and for providing guiding slots as is known in the art. The trimmer comb 100 has a toothed front side of which a detail is magnified. The toothed front side comprises intermediate guard teeth 11' and narrow teeth 12 arranged side-by-side in an alternating manner. The intermediate guard teeth 11' have a bent over portion 11*a*. It is to be understood that the step of forming a base sheet into an intermediate trimmer comb 100 (e.g. by punching or etching) and the step of bending over the bent-over portions 11*a* of the intermediate guard teeth 11' could be a single integrated step (e.g. a punching step in which the protrusions 11*a*' of the intermediate guard teeth 11' are folded as an effect of a preformed negative into which the base sheet 10 is pressed during punching). In the folding part of the punching and folding step, also other parts of the base sheet 10 could become folded or elevated as, e.g., the elevated section 17 (it is referred to FIG. 8, a side view of the intermediate trimmer comb, in which the elevated section 17 is clearly depicted). In an exemplary realization, the various steps of punching out the teeth 11, 12 and the perforations 19 (FIG. 6) and folding the elevated section 17 into the base sheet and bending over the bent-over portions 11*a* could are individual steps performed by a follow-on composite tool. Instead of punching other known techniques could be used to form the teeth, e.g. etching, wire erosion, laser cutting, or water jet cutting.

FIG. 5 shows a top view onto the intermediate trimmer comb 100 as depicted in FIG. 4. Details about the intermediate guard teeth 11' and the narrow teeth 12 are shown in and discussed with reference to FIG. 6. In the shown embodiment, the narrow teeth 12 extend from their basis at the base sheet 10 until a line L1 and the intermediate guard teeth 11' are bent over in such a manner that they extend from their basis at the base sheet 10 until a line that essentially will become a skin contact edge L2 of the final trimmer comb (shown in FIG. 8). The intermediate trimmer comb 100 has two non-toothed side portions 18 concluding the toothed front side.

Instead of an intermediate trimmer comb 100 with a linear skin contact edge L2, the intermediate trimmer comb 100 could also have a curved skin contact edge L2. In other embodiments, two or a multiplicity of narrow teeth 12 could be arranged between two intermediate guard teeth 11'. While the subject matter of the description covers also embodiments with one single tooth geometry (only intermediate guard teeth 11' are arranged side by side), it is to be noted that an alternate arrangement of intermediate guard teeth 11' and narrow teeth 12 in combination with narrow tooth gaps allows the manufacture of relatively large sized thickened tips while ensuring a high cutting efficiency and optimized reduction of the risk of skin injuries.

In FIG. 6, a detail A of the intermediate trimmer comb as depicted in FIG. 5 is shown, but with the bent-over portions 11*a*, which are shown in FIG. 5 in a bent over state, shown as protrusions 11*a*' before bending for sake of clarity of the depiction. Intermediate guard teeth 11' and narrow teeth 12 are arranged side-by-side in an alternate manner. The narrow teeth 12 extend from their basis at the base sheet 10 until a line L1 and the intermediate guard teeth 11' are bent over (as shown in FIGS. 4 and 5) at a line L2 that will essentially become the skin contact edge of the final trimmer comb. The distance between the line L1 and the line L2 is about the thickness d of the base sheet material (it is referred to FIG. 8, where the thickness d of the base sheet material is indicated). The intermediate guard teeth 11' and the narrow teeth 12 are tapered towards the line L1. The spacing distance between a pair of a guard tooth 11 and a narrow tooth 12 is D1, so that the average spacing distance between the teeth of the proposed comb is $D_{avg}$=D1/2. The base spacing of an intermediate guard tooth (and hence of a guard tooth 11 in its final stage as discussed further below) measured between a base centre of a tooth gap 13 on one side of an intermediate guard tooth 11' to the base centre of a tooth gap 13 on the other side of the same intermediate guard tooth 11' is D2 and the base spacing of a narrow tooth 12 measured between a base centre of a tooth gap 13 on one side of a narrow tooth 12 to the base centre of a tooth gap 13 on the other side of the same narrow tooth 12 is D2', so that D1=D2+D2'=2·$D_{avg}$. It is a specific feature of the discussed embodiments that D2>D2', as the smaller base spacing D2' of the narrow teeth 12 leads to the good cutting efficiency, while the larger base spacing D2 of the guard teeth 11 allows to have wide tips of the guard teeth 11 of the final trimmer comb. The centre width of the guard teeth 11 is $W_c$ and the centre width of the narrow teeth 12 is $w_c$. In one embodiment, $W_c$ is about 0.5 mm and $w_c$ is about 0.3 mm. The intermediate guard teeth 11' have a width $W_b$ at line L1 that is smaller than the centre width of the guard teeth, $W_b<W_c$. The protrusion 11*a*' of the intermediate guard teeth 11' first broadens to a middle section of the bent-over portion 11*a*, where the bent-over portion 11*a* has a width $W_t$, and than the protrusion 11*a*' tapers again. As will be discussed in connection with FIG. 8, the protrusion 11*a*' provides base sheet material for manufacturing a thickened tip much thicker than the base sheet material by melting the bent-over portion 11*a* and the broadened middle section of the protrusion 11*a*' was found to improve the manufacturing process. Nevertheless, it is to be understood that any other form of the protrusion 11*a*' is also encompassed by the description. The centre width of a tooth gap 13 is D3, which in an exemplary embodiment is about 0.3 mm or less. The centre-to-centre distance between a narrow tooth 12 and an adjoining tooth gap 13 is D4, which is in the shown embodiment equal to the centre width D3 of a tooth gap 13 or equal to the centre width $w_c$ of a narrow tooth 12, hence, $w_c \approx D3 \approx D4$. Nevertheless, any variation to these geometric parameters is also possible and may be chosen according to the desired reduction in possible skin injuries (via skin penetrating through the tooth gaps and getting cut) and the desired cutting efficiency (the smaller the tooth gaps 13 are in comparison with the narrow tooth 12, the lower the cutting efficiency will become). As mentioned before, the subject matter of the description also covers embodiments where only guard teeth 11 are arranged side-by-side, e.g. if a thick base sheet 10 is used and wide tooth gaps 13 can be accepted as the skin will not penetrate through the tooth gaps of a thick base sheet.

FIG. 7 shows a frontal view onto the toothed front side of the intermediate trimmer comb 100. A detail of the frontal view is magnified for improved visibility of details. The bent-over portions 11*a* of the intermediate guard teeth can be seen as well as the narrow teeth 12. The elevated section 17 of the base sheet is also visible. As is known in the art, the elevated section 17 is used for reduced friction between the final trimmer comb and the trimmer blade (not shown).

In FIG. 8 a side view onto the intermediate trimmer comb 100 is shown. The elevated section 17 of the base sheet 10 is clearly visible. The thickness d of the base sheet 10 is indicated. In the shown embodiment, a base sheet thickness of d=0.3 mm is chosen to ensure that hairs are cut as close to the skin as possible and to allow for a low tooth spacing. In this side view also the non-toothed side section 18 of the intermediate trimmer comb 100 is depicted as well as the bent-over portion 11*a* of an intermediate guard tooth. In FIG. 6 it is also indicated that a beam of energy 51 emitted from an energy source 50 is directed towards the bent-over portion 11*a* of the intermediate guard tooth. Such a beam of energy 51 could e.g. be a laser beam emitted from a laser source. Using a laser beam, it is advisable to surround the intermediate trimmer comb with a protective inert gas such as argon. When applying energy to the bent-over portion 11*a*, the base sheet material (e.g. steel) provided by the bent-over portion 11*a* melts and a molten tip portion results, so that the guard teeth 11 have extremely thickened tips as a result of the manufacturing process (as will be discussed in connection with FIG. 9).

In FIG. 9, a side view onto a trimmer comb 1 in its final stage is shown. The energy that was applied to the bent-over portions 11*a* of the intermediate guard teeth 11' has molten most of the base sheet material provided by the bent-over portions 11*a* and a molten tip portion llb results. Due to the surface tension of the material in its molten state, an essentially spherical thickening will usually result. By fine-tuning the amount of energy applied to the bent-over portion 11*a* it can be achieved that a non-molten remainder 11*c* of the bent-over portion 11*a* and of the guard tooth 11 remains, so that the molten tip portion llb is only formed on the skin side S1 of the trimmer comb 1. Specifically, the blade side S2 of the trimmer comb is not affected by the step of applying energy to the bent-over portions 11*a* and the non-molten remainder 11*c* is left over. The side S2 of the toothed front side may be grinded or polished to assure optimal flatness and hence optimal contact with the trimmer blade.

When mounted in a hair trimmer device, the trimmer comb 1 will contact the skin with its skin side S1. Hence, the smooth molten tip portions llb will contact the skin and a pleasant skin contact sensation results. As the process of manufacturing the molten tip portions llb allows spherical thickenings llb that have a diameter D that is much larger than the thickness d of the base sheet 10 (in the shown embodiment, a diameter D of 0.7 mm is achieved, which is more than twice the thickness d=0.3 mm of the base sheet material), a thin base sheet 10 can be used while thickened tips of the guard teeth 11 can be provided that are large enough to effectively reduce any hooking of the guard tooth tips into skin pores or hair channels. It is also to be noted that the diameter D of the molten tip portion (or the width measured in longitudinal extension direction y) is in the discussed embodiment slightly larger than the average spacing distance $D_{avg}$ between the teeth of the proposed comb, where D=0.7 mm and $D_{avg} \approx 1.35$ mm/2 The proposed reduced geometry of the narrow teeth 12 obtained by a combination of retracted narrow teeth 12 and of a small base spacing D2' (as indicated in FIG. 6), where D2'=0.55 mm in comparison to the base spacing D2=0.8 mm of the guard teeth 11 in the exemplary embodiment, allows having thickened tip that are wider (diameter D) in y direction than the average spacing distance $D_{avg}$. Various deviations to these geometric parameters of the shown exemplary embodiment are of course possible and are encompassed by the subject matter of the description.

FIG. 10 shows a perspective view onto the trimmer comb 1 in its final stage.

FIG. 11 shows a magnification of the detail A' that is indicated in FIG. 10. The magnification shows the molten tip portions llb that had been formed at the tips of the guard teeth 11 by applying energy to the bent-over portions 11*a* so that the material provided by the bent-over portions 11*a* was (mostly) molten. By fine-tuning the amount of energy applied to the bent-over portions 11*a*, it can be achieved that non-molten remainders 11*c* of the bent-over portions 11*a* remain, so that the molten tip portions 11*b* are only formed on that side of the trimmer comb 1 to which the bent-over portions 11*a* were bent over (which here is the skin side S1 as depicted in FIG. 9). The blade side S2, as depicted in FIG. 9, would in this case not be affected by the melting process and burrs and/or sharp edges are not formed at the blade side even if the blade side is grinded and/or polished after the step of applying energy to the bent-over portions 11*a* and melting them. The guard teeth 11 of the trimmer comb 1 in its final stage do not extend beyond the skin contact edge L2, as depicted in FIG. 5, as in the step of applying energy to the bent-over portions 11*a*, the melting material topples over onto the guard teeth 11 or sinks into the molten mass, specifically when the energy is applied onto the side of the bent-over portions 11*a* that faces the base sheet 10, as is depicted in FIG. 8. In the shown embodiment, the narrow teeth 12 do extend until about the centre of the molten tip portions llb of the guard teeth 11. In this embodiment, hooking of the tips of the narrow teeth 12 into skin pores or hair channels is effectively avoided as the tips of the narrow teeth 12 cannot contact the skin. Further, as the narrow teeth 12 do not extend to the skin contact edge L2 (as depicted in FIG. 5), hairs can easily feed into the teeth gaps 13. It is again noted that the guard teeth 11 have a centre width ($W_c$ in FIG. 6) that is wider that the centre width ($w_c$ in FIG. 4) of the narrow teeth 12 and hence allow for large molten tip portions llb that press the skin down (while providing a pleasant skin contact sensation) and also do not hook into skin pores or hair channels. The narrow teeth 12 arranged between the guard teeth 11 allow for high cutting efficiency. The specific manufacturing process as described above further allows for using a thin base sheet 10 (e.g. about 0.3 mm), while molten tip portions llb can be formed that have a diameter much larger than the base sheet thickness (in the embodiment shown, the diameter of the spherical thickening is about 2.3 times as large as the base sheet thickness).

For sake of clarity it is noted that an intermediate guard tooth 11' relates to the intermediate trimmer comb and comprises a tooth portion that extends from the base sheet and either a protrusion 11*a*' or a bent-over portion 11*a*, depending on the manufacturing stage of the intermediate trimmer comb; the guard tooth 11 relates to the trimmer comb in its final stage and comprises a tooth portion that extends from the base sheet and a molten tip portion llb and, optionally, a non-molten remainder 11*c*.

FIG. 12 shows an exemplary hair removal device 300 that comprises a hair trimmer 200 in which to a trimmer comb as described can be used. In this exemplary hair removal device, a hair trimmer device is combined with a wet shaver mounted on the back of the hair removal device. Such a hair removal device is specifically suitable for body grooming.

It is to be noted that any use of "include" or "comprise" in the description or the claims shall mean "include, but not necessarily limited to". Any use of "a" or "an" in the description or the claims in combination with a feature shall not limit this feature to be present only once but shall include also a multiple presence of the feature.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extend that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A trimmer comb (1) comprising a base sheet (10) that has a toothed front side, the toothed front side comprising a side-by-side arrangement of guard teeth (11) and narrow teeth (12), wherein the tips (15, 11*d*, 11*d*') of the guard teeth (11) are wider in the longitudinal extension direction (y) of the trimmer comb than the tips (15') of the narrow teeth (12) and the geometry of at least one narrow tooth (12) of the narrow teeth is reduced when compared to the geometry of the guard teeth (11), wherein the reduced geometry is obtained in that the length (E2) of the narrow tooth (12) measured in an axial direction (x) of the trimmer comb is smaller than the length (E1) of the guard teeth (11) and the base spacing (D2') of the narrow tooth (12) is smaller than the base spacing (D2) of the guard teeth (11) and the thickness of the base sheet at the toothed front side is equal to or smaller than about 0.4 mm, and further, wherein at least a guard tooth has a thickened tip that is thickened in a height direction and the thickened tip is extending to the side of the guard tooth that would contact a user's skin, wherein the thickened tip comprises a thickened tip portion that is a spherical structure having a diameter larger than the thickness of the base sheet, wherein said spherical structure has a maximal width and the maximal width of the spherical structure is realized at a different height position than the height position of the narrow tooth.

2. The trimmer comb according to claim 1 wherein between two guard teeth (11) the narrow tooth (12) is arranged, wherein the guard teeth (11) and the narrow teeth (12) are arranged in an alternating manner.

3. The trimmer comb according to claim 1, wherein the, thickness (d) of the base sheet (10) is equal to or smaller than 0.3 mm.

4. The trimmer comb according to claim 1, wherein the centre spacing distance (D4) between the centre of the narrow tooth (12) and the centre of an adjoining tooth gap (13) is smaller than the centre width ($W_c$) of a guard tooth.

5. The trimmer comb according to claim 1, wherein the tips (15, 11*d*, 11*d*') of the guard teeth (11) define a skin contact edge (L2).

6. The trimmer comb according to claim 5, wherein the tips (15, 11*d*, 11*d*') of the guard teeth (11) are about as wide or wider in the longitudinal extension direction (y) of the trimmer comb than the average spacing distance ($D_{avg}$) between the guard teeth (11) and the narrow teeth (12).

7. The trimmer comb according to claim 1, wherein the centre width ($w_c$) of the narrow tooth (12) is at least 20% smaller than the centre width ($W_c$) of a guard tooth (11) of the grand teeth.

8. The trimmer comb according to claim 1, wherein the diameter (D) of the spherical structure (11*b*) is at least 50% larger than the thickness (d) of the base sheet (10).

9. A hair removal device (300) comprising a trimmer comb according to claim 8.

10. A hair trimmer (200) comprising at least a trimmer comb (1) according to claim 1, wherein the trimmer comb (1) cooperates with a trimmer blade (8) to cut hairs in a use operation.

11. The hair trimmer according to claim 10, wherein the trimmer blade (8) has a toothed front side that is—in an operating state of the hair trimmer—relatively moved with respect to the toothed front side of the trimmer comb (1).

* * * * *